US008904773B2

(12) United States Patent
Maruyama et al.

(10) Patent No.: US 8,904,773 B2
(45) Date of Patent: Dec. 9, 2014

(54) COOLING WATER PASSAGE STRUCTURE IN CYLINDER HEAD OF INTERNAL COMBUSTION ENGINE

(75) Inventors: Sei Maruyama, Wako (JP); Tetsushi Kakuda, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 842 days.

(21) Appl. No.: 13/049,916

(22) Filed: Mar. 17, 2011

(65) Prior Publication Data

US 2011/0226197 A1 Sep. 22, 2011

(30) Foreign Application Priority Data

Mar. 17, 2010 (JP) ..... 2010-060312

(51) Int. Cl.
*F01N 3/02* (2006.01)
*F02F 1/40* (2006.01)

(52) U.S. Cl.
CPC ..... *F02F 1/40* (2013.01)
USPC ..... 60/321; 60/323

(58) Field of Classification Search
CPC ..... F02F 1/40; G01N 3/046
USPC ..... 60/321, 323; 123/41.82 R, 41.31
See application file for complete search history.

(56) References Cited

U.S. PATENT DOCUMENTS

| | | | | |
|---|---|---|---|---|
| 7,367,294 | B2 * | 5/2008 | Rozario et al. | 123/41.82 R |
| 7,849,683 | B2 * | 12/2010 | Asame et al. | 60/323 |
| 8,474,251 | B2 * | 7/2013 | Beyer et al. | 60/321 |
| 8,544,427 | B2 * | 10/2013 | Maruyama et al. | 123/41.82 R |
| 2009/0084332 | A1 * | 4/2009 | Nagafuchi | 123/41.79 |
| 2009/0241526 | A1 * | 10/2009 | Son et al. | 60/321 |
| 2010/0251704 | A1 * | 10/2010 | Asame et al. | 60/323 |
| 2012/0073528 | A1 * | 3/2012 | Kim et al. | 123/41.82 R |
| 2012/0312257 | A1 * | 12/2012 | Beyer et al. | 123/41.82 R |
| 2013/0055971 | A1 * | 3/2013 | Brewer et al. | 123/41.82 R |

FOREIGN PATENT DOCUMENTS

| | | | | |
|---|---|---|---|---|
| JP | 2002-70642 | | 3/2002 | |
| JP | 2002070642 | A * | 3/2002 | F02F 1/36 |
| JP | 2007187110 | A * | 7/2007 | |
| JP | 2009-115031 | | 5/2009 | |
| JP | 2009-257157 | | 11/2009 | |

OTHER PUBLICATIONS

Japanese Office Action for corresponding JP Application No. 2010-060312, Mar. 13, 2012.
Chinese Office Action for corresponding CN Application No. 201110046161.0, Jul. 30, 2012.

* cited by examiner

*Primary Examiner* — Jesse Bogue
*Assistant Examiner* — Matthew T Largi
(74) *Attorney, Agent, or Firm* — Mori & Ward, LLP

(57) ABSTRACT

A cooling water passage structure in a cylinder head of an internal combustion engine includes a first exhaust-side cooling water passage and a second exhaust-side cooling water passage arranged to sandwich an exhaust collecting portion and extending in a lengthwise direction of the cylinder head. An exhaust pipe is fastened to a exhaust-side lateral surface of the cylinder head via a fastening member. A shunt passage is formed in at least one of the first exhaust-side cooling water passage and the second exhaust-side cooling water passage to cool the fastening member and is formed along a water flow in the first exhaust-side cooling water passage or the second exhaust-side cooling water passage by partly expanding the first exhaust-side cooling water passage or the second exhaust-side cooling water passage to increase a passage cross-sectional area of the first exhaust-side cooling water passage or the second exhaust-side cooling water passage.

5 Claims, 10 Drawing Sheets

COOLING WATER PASSAGE STRUCTURE IN CYLINDER HEAD OF INTERNAL COMBUSTION ENGINE

CROSS-REFERENCE TO RELATED APPLICATIONS

The present application claims priority under 35 U.S.C. §119 to Japanese Patent Application No. 2010-060312, filed Mar. 17, 2010, entitled "Cooling Water Passage Structure In Cylinder Head Of Internal Combustion Engine". The contents of this application are incorporated herein by reference in their entirety.

BACKGROUND OF THE INVENTION

1. Field of the Invention

The present invention relates to a cooling water passage structure in a cylinder head of an internal combustion engine.

2. Description of the Related Art

A multi-cylinder engine is generally constructed such that a plurality of intake ports and a plurality of exhaust ports are formed inside a cylinder head, and an intake manifold for distributing intake air and an exhaust manifold for collecting exhaust gases are connected respectively to an intake-side lateral surface and an exhaust-side lateral surface of the cylinder head. In another known construction, an exhaust collecting portion for collecting exhaust gases is also formed inside the cylinder head, and a single exhaust pipe is connected to the exhaust-side lateral surface of the cylinder head. The multi-cylinder engine provided with the exhaust collecting portion formed inside the cylinder head has the following advantages. Because of no need of separately providing the exhaust manifold, the size of the entire engine can be reduced. Further, because heat released from the exhaust gases can be suppressed, the catalyst temperature can be more quickly raised for earlier activation in warming-up. However, the exhaust gases need to be properly cooled in order to prevent thermal deterioration of a catalyst, which may be caused due to an excessive temperature rise. Moreover, a countermeasure is required to protect, against thermal damage, bolts for fastening the exhaust pipe that is coupled to the cylinder head immediately downstream of the exhaust collecting portion.

Additionally, in the cylinder head provided with the exhaust collecting portion formed therein, when a large cooling water passage is formed around the exhaust collecting portion, a boss portion for the bolt for fastening the exhaust pipe, which is disposed immediately downstream of the exhaust collecting portion, is projected into the cooling water passage. Within the cooling water passage, therefore, vortexes are generated downstream of the boss portion for the bolt, thus causing cooling water to stagnate. Hence, the cooling effect with the cooling water passage is reduced. To overcome the above-mentioned problem, an invention is proposed in which an auxiliary cooling water passage is formed such that the cooling water in a cylinder block is caused to flow into the cooling water passage and to direct toward a vortex generation region (see Japanese Unexamined Patent Application Publication No. 2009-115031).

SUMMARY OF THE INVENTION

According to one aspect of the present invention, a cooling water passage structure in a cylinder head of an internal combustion engine includes a first exhaust-side cooling water passage, a second exhaust-side cooling water passage, and a shunt passage. The first exhaust-side cooling water passage and a second exhaust-side cooling water passage are arranged to sandwich an exhaust collecting portion of the cylinder head and extend in a lengthwise direction of the cylinder head. The exhaust collecting portion is formed in the cylinder head to define an exhaust opening in an exhaust-side lateral surface of the cylinder head and to collect exhaust gases exhausted from a plurality of combustion chambers which are arrayed in a line. An exhaust pipe is fastened to the exhaust-side lateral surface of the cylinder head via a fastening member and is adapted to arrange an exhaust cleaner immediately downstream of the exhaust opening. The shunt passage is formed in at least one of the first exhaust-side cooling water passage and the second exhaust-side cooling water passage to cool the fastening member. The shunt passage is formed along a water flow in the first exhaust-side cooling water passage or the second exhaust-side cooling water passage by partly expanding the first exhaust-side cooling water passage or the second exhaust-side cooling water passage to increase a passage cross-sectional area of the first exhaust-side cooling water passage or the second exhaust-side cooling water passage.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
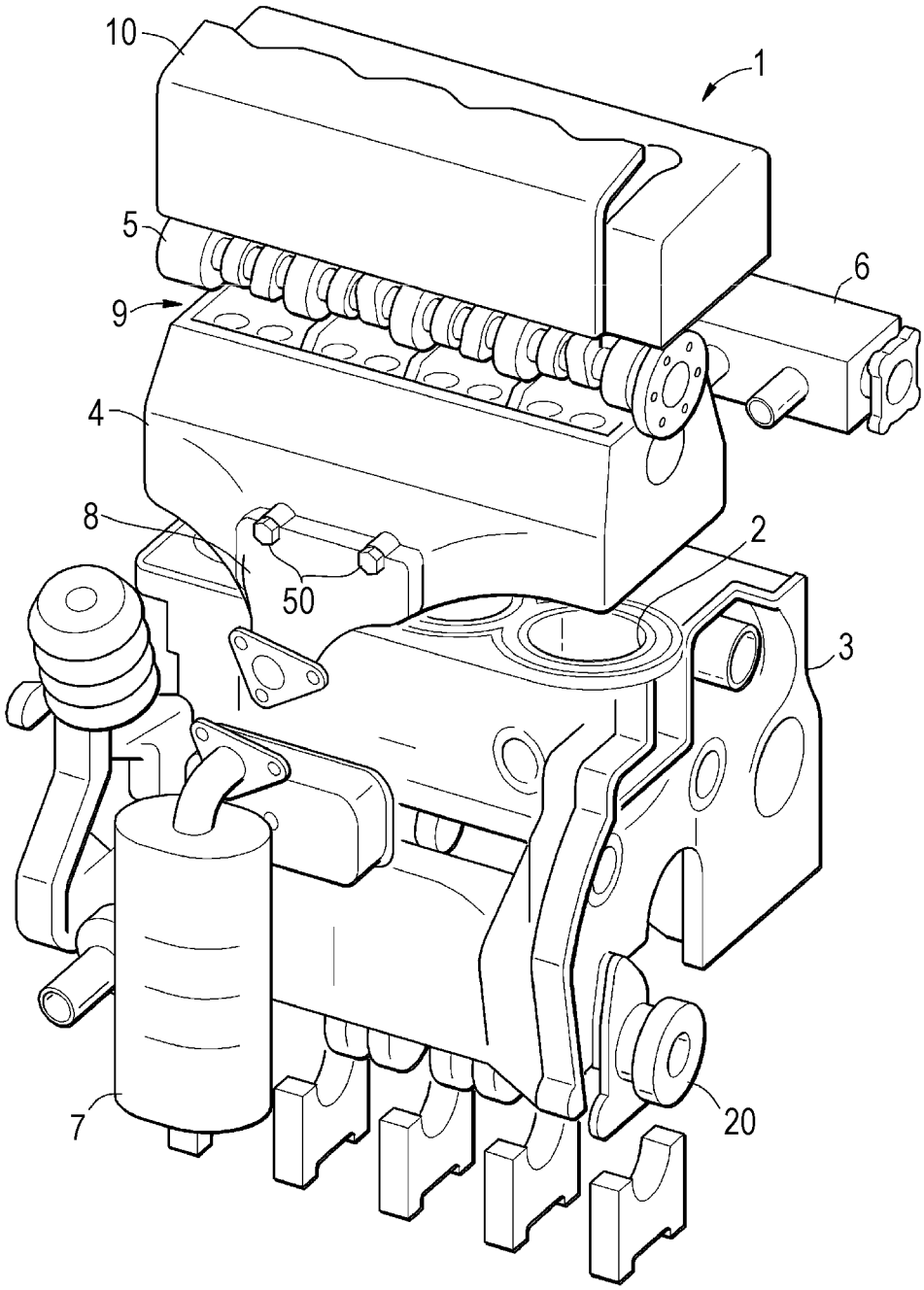
FIG. 1 is an exploded perspective view of a multi-cylinder engine according to an embodiment.

The embodiments will be described in detail below with reference to the accompanying drawings, wherein like reference numerals designate corresponding or identical elements throughout the various drawings. Be it noted that, in the following description, up and down directions are defined on the basis of a state where an engine 1 is mounted on, e.g., an automobile.

As illustrated in FIG. 1, the engine 1 is an in-line 4-cylinder gasoline engine for an automobile. The engine 1 includes a cylinder block 3 defining therein a plurality (four in the illustrated embodiment) of cylinders 2 which are arrayed in a line, a cylinder head 4 fastened to an upper surface of the cylinder block 3 and rotatably supporting a cam shaft 5, an intake manifold 6 fastened to one lateral surface of the cylinder head 4, the one lateral surface extending in a direction in which the cylinders 2 are arrayed, an exhaust pipe 8 having one end that is fastened by exhaust pipe fastening bolts 50 to the other lateral surface of the cylinder head 4 on the side away from the intake manifold 6, and having the other end that is fastened to a flange portion of an exhaust cleaner 7, and a cylinder head cover 10 fastened to an upper surface of the cylinder head 4 and covering a valve train 9 that is constituted by the cam shaft 5 and other not-shown components including a rocker arm. The engine 1 is of the 4-valve type including two intake valves and two exhaust valves for each cylinder 2. Those intake and exhaust valves are driven to be opened and closed by a crankshaft 20 through the valve train 9.

Figure 2:
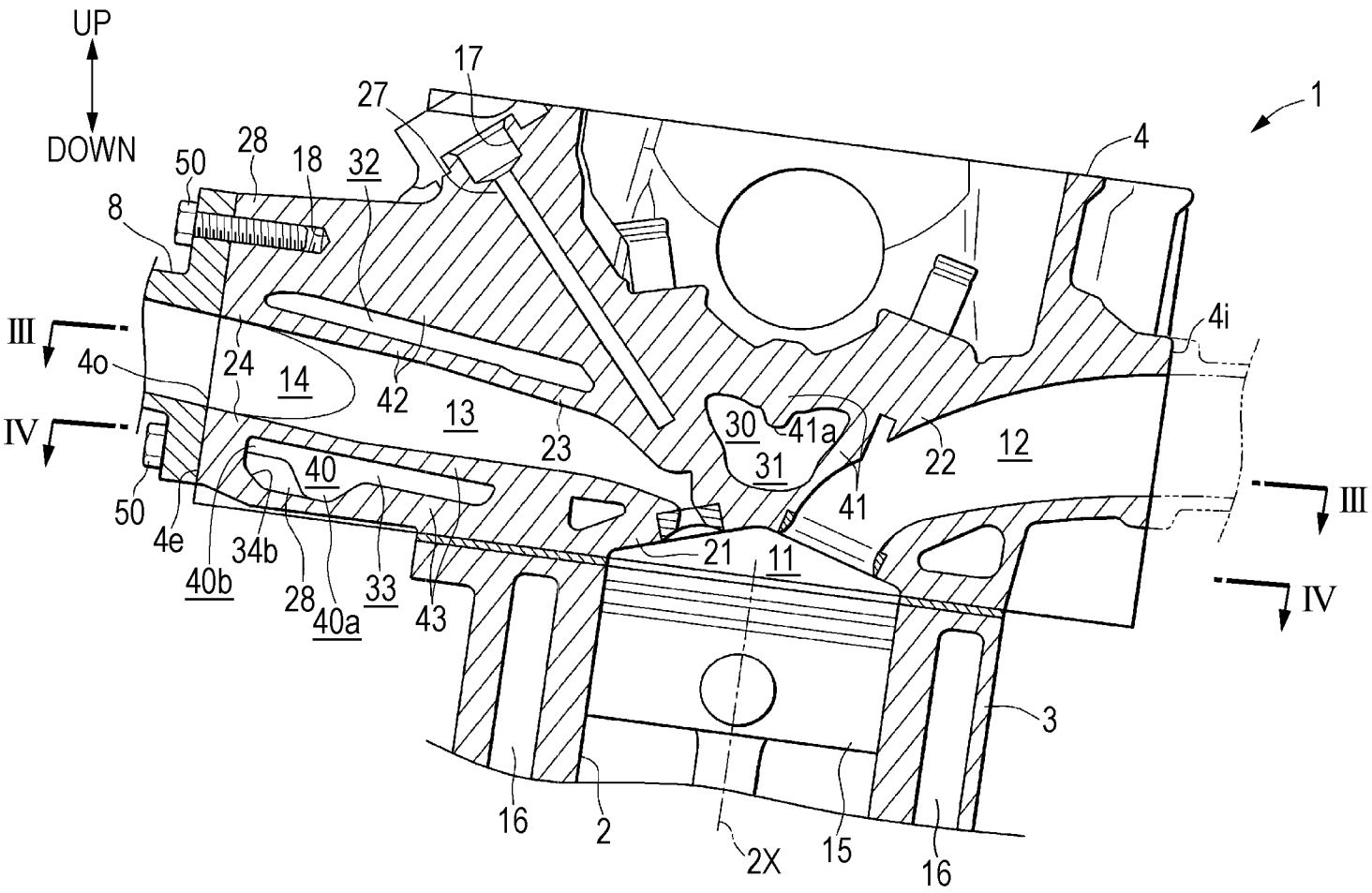
FIG. 2 is a sectional view, taken along a line II-II in FIGS. 3 and 4, of principal part of the internal combustion engine according to the embodiment.

As detailed in FIG. 2, a piston 15 is slidably inserted in each of the cylinders 2 defined in the cylinder block 3, and a combustion chamber 11 is formed between an upper surface of the piston 15 and a lower surface of the cylinder head 4. Further, a cylinder-block cooling water passage 16 is formed inside the cylinder block 3 to surround the cylinder 2. The engine 1 is mounted in an engine room in such a state that a cylinder axis 2X is inclined in a direction causing an exhaust-side lateral surface 4*e* of the cylinder head 4 to direct upwards.

Figure 3:
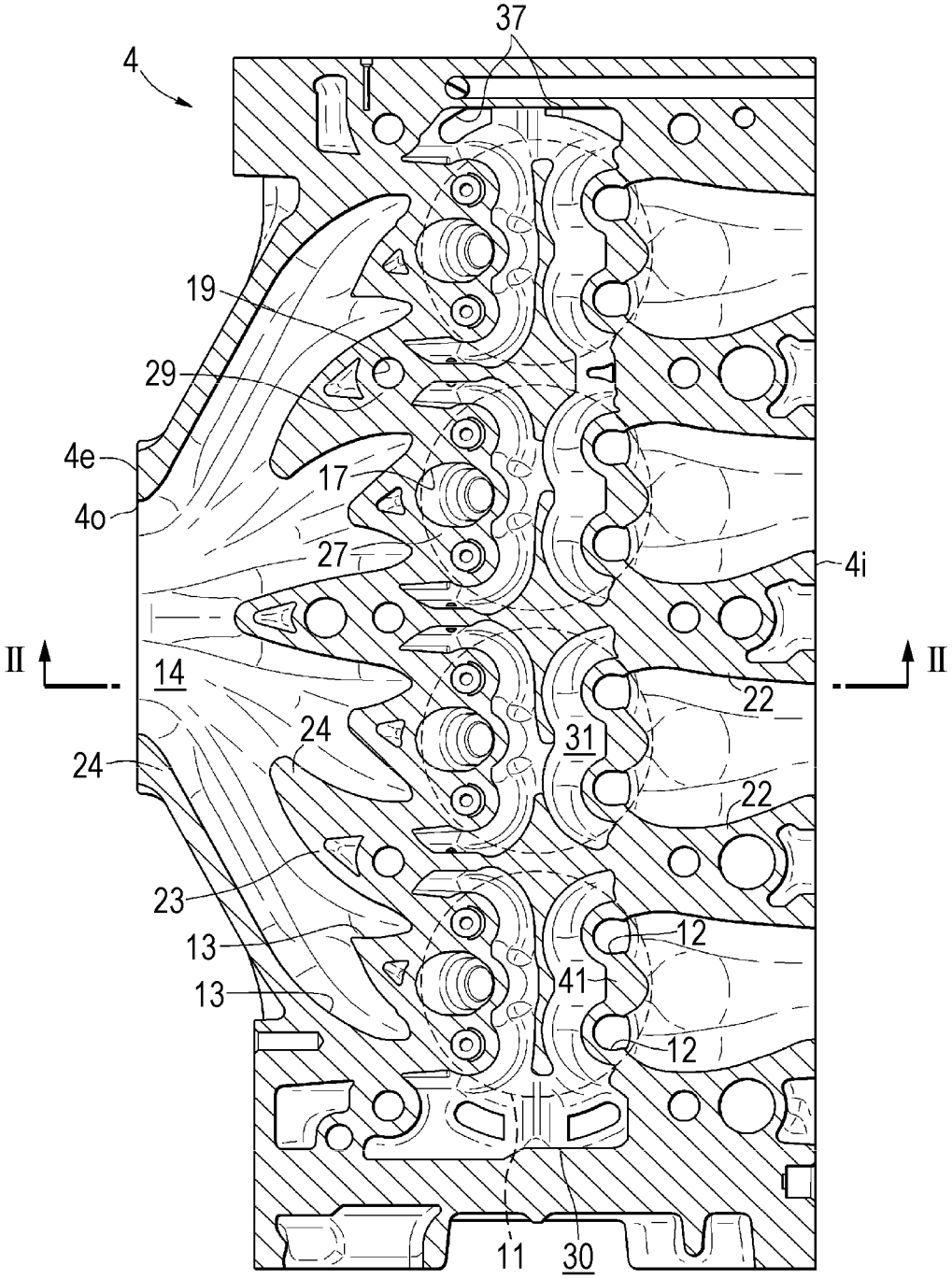
FIG. 3 is a sectional view taken along a line III-III in FIG. 2.

The cylinder head 4 is recessed in portions of its lower surface that is connected to the cylinder block 3, and it defines therein a total of four combustion chambers 11 in one-to-one relation to the cylinders 2. As illustrated in FIGS. 2 and 3, the combustion chambers 11 are arrayed in a line along the lengthwise direction of the cylinder head 4 similarly to the cylinders 2. Further, the cylinder head 4 defines therein a total of eight intake ports 12, i.e., two for each cylinder 2. The intake ports 12 are opened in one lateral surface of the cylinder head 4 extending in the lengthwise direction thereof (the one lateral surface being referred to as an "intake-side lateral surface 4*i*" hereinafter). Still further, the cylinder head 4 defines therein not only a total of eight exhaust ports 13, i.e., two for each cylinder 2, but also an exhaust collecting portion 14 for collecting exhaust gases exhausted from the four cylinders 2 to the eight exhaust ports 13. In other words, a single exhaust opening 4*o* is formed in the other lateral surface, i.e., the exhaust-side lateral surface 4*e*, of the cylinder head 4. The exhaust pipe 8 is fastened to the exhaust-side lateral surface 4*e* of the cylinder head 4 by the exhaust pipe fastening bolts 50, which are positioned two in each of the upper and lower sides of the exhaust pipe 8. The exhaust cleaner 7 is arranged immediately downstream of the exhaust opening 4*o*.

In the following description, a wall portion of the cylinder head 4 defining the combustion chamber 11 is called a "combustion chamber defining portion 21", a wall portion of the cylinder head 4 defining the intake port 12 is called an "intake port defining portion 22", a wall portion of the cylinder head 4 defining the exhaust port 13 is called an "exhaust port defining portion 23", and a wall portion of the cylinder head 4 defining the exhaust collecting portion 14 is called an "exhaust-collecting-portion defining portion 24".

Moreover, the cylinder head 4 includes an ignition plug insertion hole 17 in which an ignition plug (not shown) is inserted so as to face the combustion chamber 11, bolt holes 18 in which the exhaust-pipe fastening bolts 50 are inserted to fasten the exhaust pipe 8, and bolt holes 19 arranged at opposite ends of a cylinder train and between adjacent two of the cylinders 2 for fastening the cylinder head 4 to the cylinder block 3.

In the following description, a wall portion of the cylinder head 4 defining the ignition plug insertion hole 17 is called an "insertion hole defining portion 27", a wall portion of the cylinder head 4 defining the bolt hole 18 is called an "exhaust-pipe fastening boss portion 28", and a wall portion of the cylinder head 4 defining the bolt hole 19 is called a "cylinder-head fastening boss portion 29".

Figure 4:
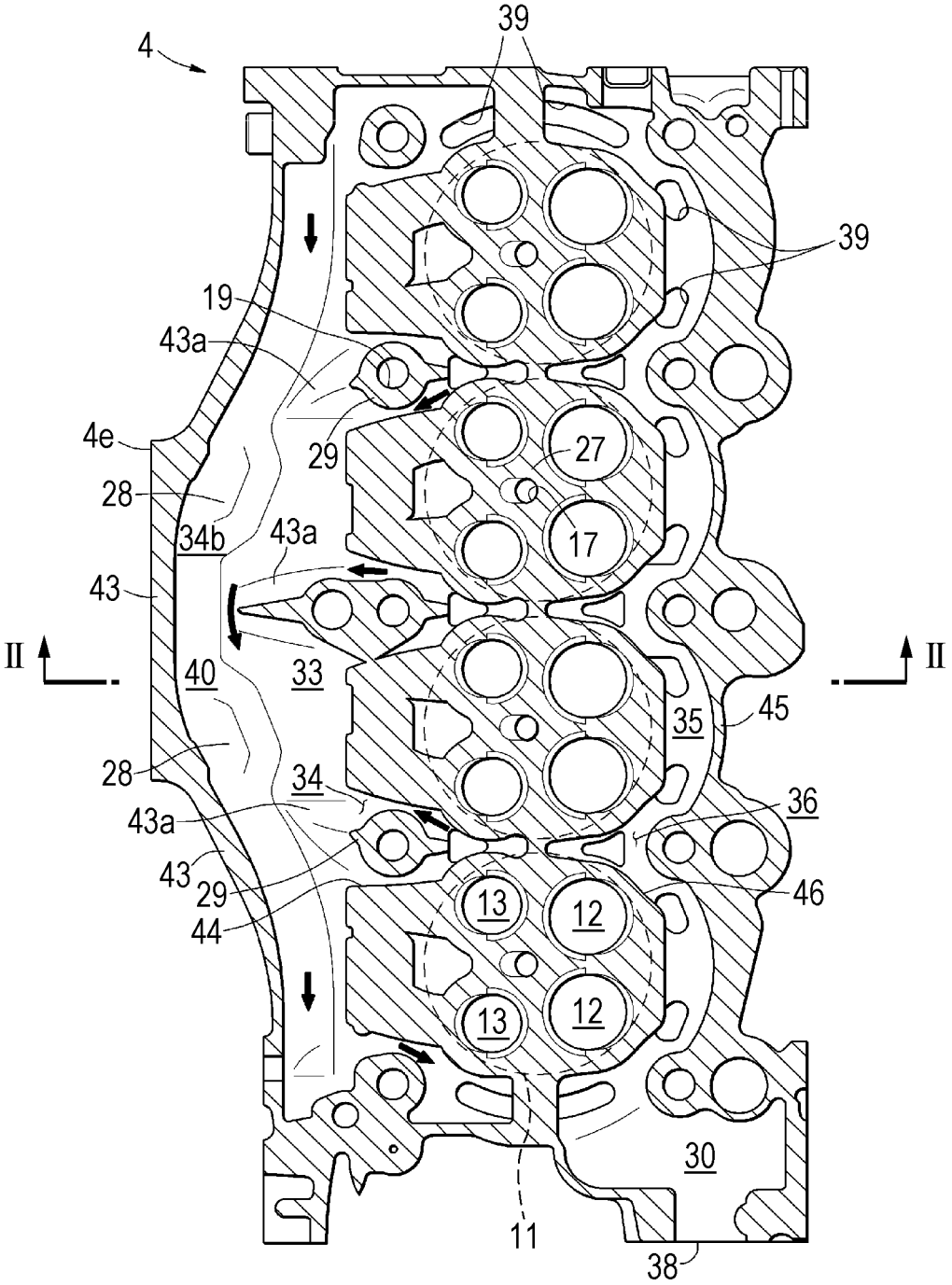
FIG. 4 is a sectional view taken along a line IV-IV in FIG. 2.

Inside the cylinder head 4, as illustrated in FIGS. 2 to 4, a cylinder-head cooling water passage 30 is formed around the combustion chambers 11, the exhaust ports 13, and the exhaust collecting portion 14 to prevent overheating that may be caused in the combustion chambers 11 and in the exhaust port 13 by heat transferred from the exhaust gases. The cylinder-head cooling water passage 30 includes, as primary parts, a main cooling water passage 31 extending in the lengthwise direction of the cylinder head 4 while passing immediately above the four combustion chambers 11, an upper exhaust-side cooling water passage 32 and a lower exhaust-side cooling water passage 33 arranged at positions sandwiching the exhaust collecting portion 14 from above and below, respectively, and extending in the lengthwise direction of the cylinder head 4, an exhaust-side communication passage 34 communicating the main cooling water passage 31 with the upper exhaust-side cooling water passage 32 and with the lower exhaust-side cooling water passage 33, an intake-side cooling water passage 35 arranged on the side close to the intake ports 12 and extending in the lengthwise direction of the cylinder head 4, and an intake-side communication passage 36 communicating the main cooling water passage 31 with the intake-side cooling water passage 35.

In the following description, a wall portion of the cylinder head 4 defining the main cooling water passage 31 is called a "main passage defining portion 41", a wall portion of the cylinder head 4 defining the upper exhaust-side cooling water passage 32 is called an "upper exhaust-side passage defining portion 42", a wall portion of the cylinder head 4 defining the lower exhaust-side cooling water passage 33 is called a "lower exhaust-side passage defining portion 43", a wall portion of the cylinder head 4 defining the exhaust-side communication passage 34 is called an "exhaust-side communication passage defining portion 44", a wall portion of the cylinder head 4 defining the intake-side cooling water passage 35 is called an "intake-side passage defining portion 45", and a wall portion of the cylinder head 4 defining the intake-side communication passage 36 is called an "intake-side communication passage defining portion 46".

Next, details of the cylinder-head cooling water passage 30 will be described below with reference to FIGS. 2 to 12. Be it noted that, in FIGS. 5 to 8 and 11, the cylinder-head cooling water passage 30 which is actually a hollow portion formed inside the cylinder head 4 is physically illustrated as a view seeing through the cylinder head 4 in a similar way to that used when illustrating a core. On the other hand, although the defining portions 41 to 46 defining the various passages 31 to 36 and the boss portions 28 to 30 do not appear in those drawings because of seeing through the cylinder head 4, space portions corresponding to the various wall portions are denoted by symbols underlined.

Figure 6:
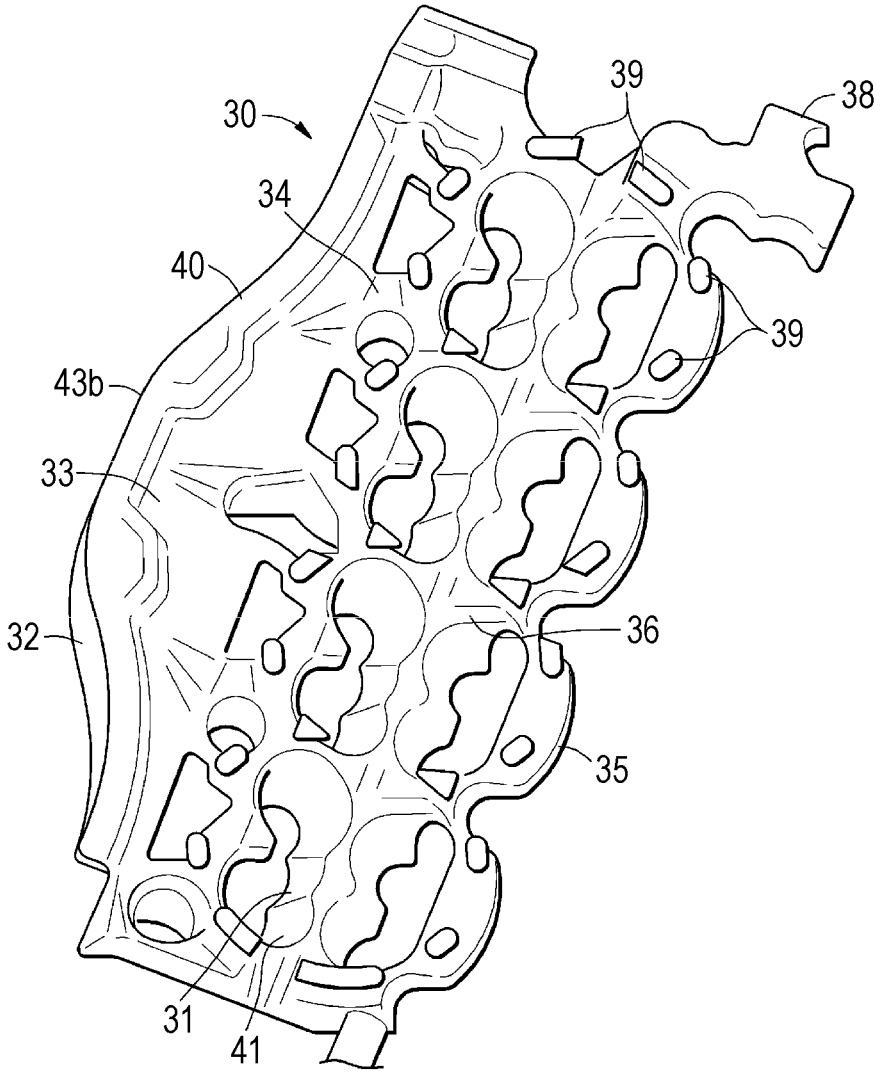
FIG. 6 is a perspective view looking the cooling water passage according to the embodiment from below.

As illustrated in FIGS. 3, 4 and 6, at one end side of the main cooling water passage 31, a cooling water inlet port 37 is formed such that cooling water supplied from a water pump (not shown) is caused to flow into the cylinder-head cooling water passage 30. At the other end side of the main cooling water passage 31, a cooling water outlet port 38 is formed such that cooling water is caused to flow out from the cylinder-head cooling water passage 30. Further, in the lower surface of the cylinder head 4, communication portions 39 are opened at appropriate positions to communicate the cylinder-head cooling water passage 30 and the cylinder-block cooling water passage 16 with each other.

Figure 5:
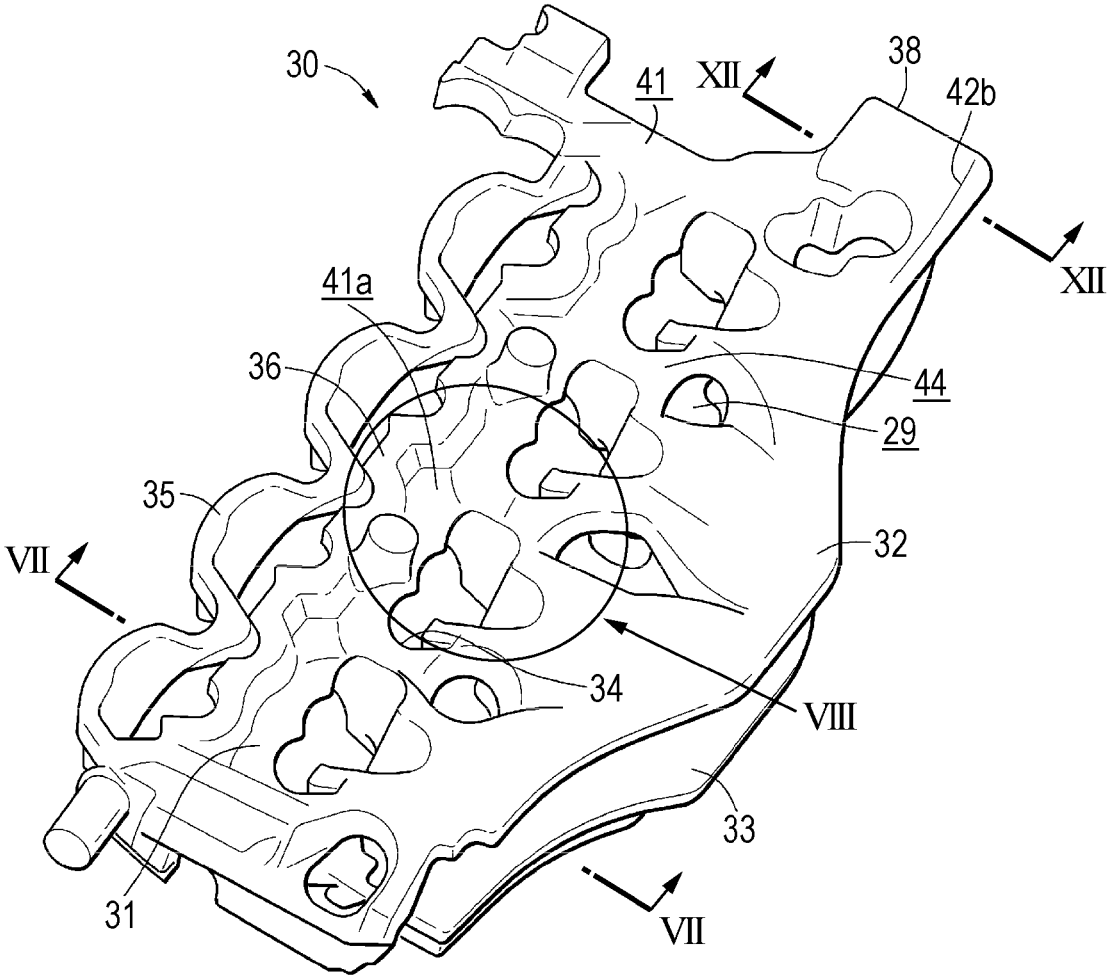
FIG. 5 is a perspective view looking a cooling water passage according to the embodiment from above.
Figure 7:
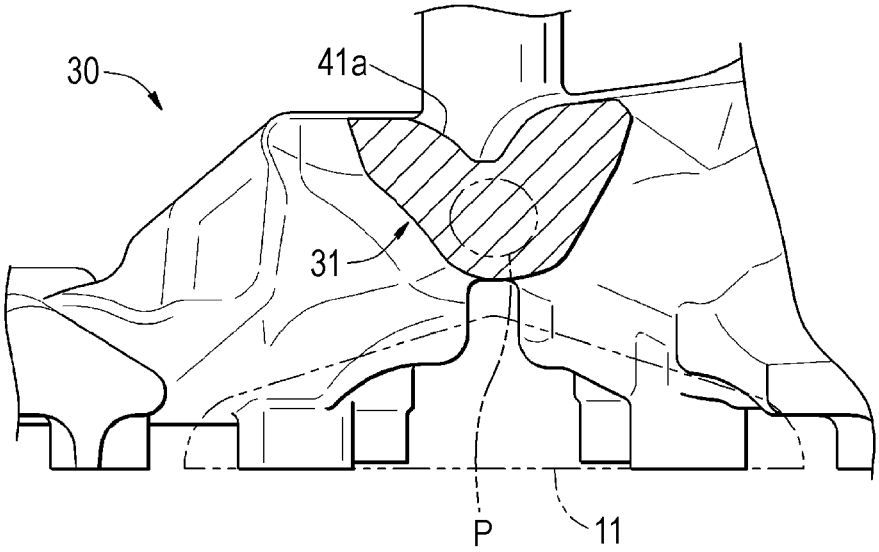
FIG. 7 is a sectional view, taken along line a VII-VII in FIG. 5, of principal part of the cooling water passage.

As illustrated in FIGS. 2 and 5, a ridge 41*a* extending in the lengthwise direction of the cylinder head 4 to adjust a flow speed of the cooling water is formed on a wall surface of the main passage defining portion 41 on the side away from the combustion chambers 11, i.e., on an upper wall surface of the main passage defining portion 41. With the provision of the ridge 41*a*, as illustrated in FIG. 7, a main flow P of the cooling water flowing through the main cooling water passage 31, i.e., a region where the cooling water flows at a maximum flow speed, is shifted toward the combustion chambers 11 and the flow speed of the cooling water flowing near the wall surface closer to the combustion chambers 11 is increased. Consequently, the effect of cooling the vicinity of the combustion chambers 11 is increased. Further, because the main flow P of the cooling water flowing through the main cooling water passage 31 advances straightforwardly without zigzagging up and down, flow passage resistance can be prevented from increasing due to the zigzag flow of the cooling water.

Figure 8:
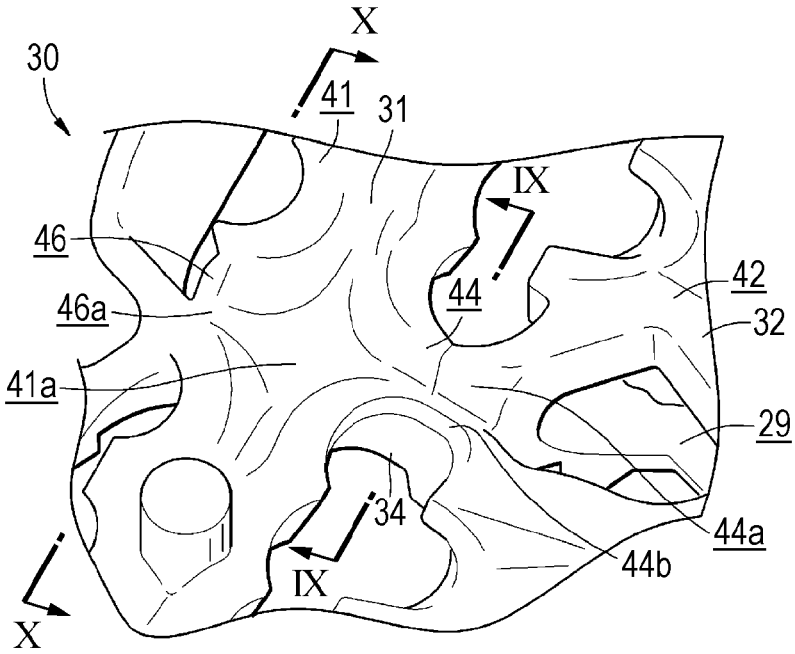
FIG. 8 is an enlarged view of a portion VIII in FIG. 5.
Figure 9:
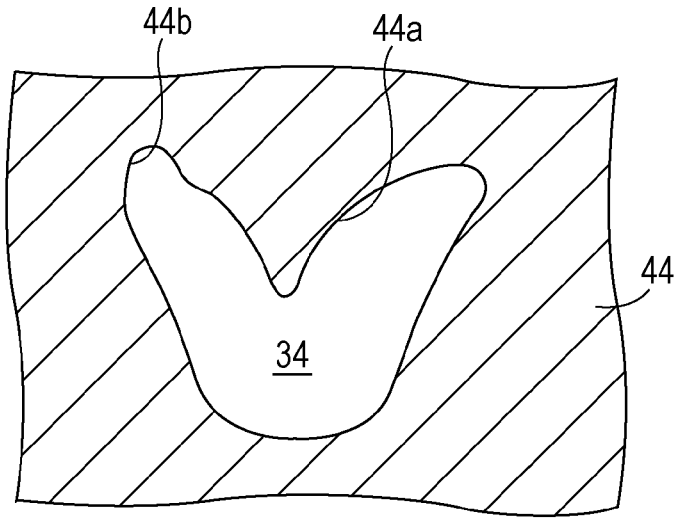
FIG. 9 is a sectional view taken along a line IX-IX in FIG. 8.

As illustrated in FIGS. 8 and 9, an exhaust-side throttle portion 44*a* extending in a direction perpendicular to the lengthwise direction of the cylinder head 4 to reduce a cross-sectional area of the exhaust-side communication passage 34 is formed on a wall surface of the exhaust-side communication passage defining portion 44 on the side away from the combustion chambers 11, i.e., on an upper wall surface of the exhaust-side communication passage defining portion 44. The exhaust-side throttle portion 44*a* is formed to be continuously joined to the ridge 41*a* projecting into the main cooling water passage 31. With the provision of the exhaust-side throttle portion 44*a* formed as described above, the cross-sectional area of the exhaust-side communication passage 34 is reduced and the flow rate of the cooling water in the main cooling water passage 31 is maintained.

Further, in the upper wall surface of the exhaust-side communication passage defining portion 44, a concave channel 44*b* recessed upwards and extending along the exhaust-side communication passage 34 is formed to move air having entered the cylinder-head cooling water passage 30 from the main cooling water passage 31 into the upper exhaust-side cooling water passage 32 that is arranged above the exhaust collecting portion 14. Air tends to stagnate in the main cooling water passage 31 because the exhaust-side throttle portion 44*a* is formed in the exhaust-side communication passage defining portion 44. With the concave channel 44*b* formed as described above, however, the air having entered the main cooling water passage 31 is movable into the upper exhaust-side cooling water passage 32. Hence, the effect of cooling the vicinity of the combustion chambers 11 with the main cooling water passage 31 can be prevented from reducing due to the presence of stagnant air.

As illustrated in FIGS. 4 and 5, a cylinder-head fastening boss portion 29 adapted to fasten the cylinder head 4 to the cylinder block 3 is projected from the exhaust-side communication passage defining portion 44 such that the exhaust-side communication passage 34 is divided into two parts by the cylinder-head fastening boss portion 29. Further, as illustrated in FIG. 8, the exhaust-side throttle portion 44*a* is formed to be continuously joined to the cylinder-head fastening boss portion 29. Therefore, the cooling water slightly flowing out from the main cooling water passage 31 flows into the upper and lower exhaust-side cooling water passages 32, 33 to efficiently cool the surroundings of the exhaust ports 13 (see FIG. 3), in which the cylinder-head fastening boss portions 29 are formed, with a relatively small amount of the cooling water.

Figure 10:
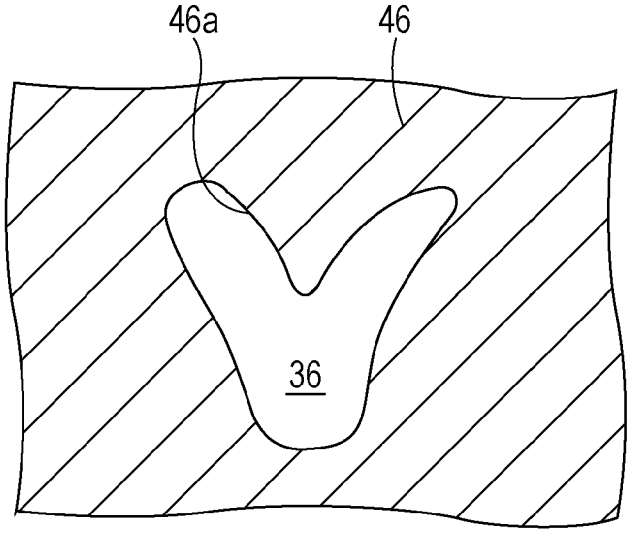
FIG. 10 is a sectional view taken along line X-X in FIG. 8.

In the intake-side communication passage defining portion 46, as illustrated in FIGS. 8 and 10, an intake-side throttle portion 46*a* is formed to reduce a cross-sectional area of the intake-side communication passage 36. The intake-side throttle portion 46*a* is formed by projecting an upper surface of the intake-side communication passage defining portion 46 downwards from its central portion such that the intake-side throttle portion 46*a* is continuously joined to the ridge 41*a*, which is projected into the main cooling water passage 31. With the provision of the intake-side throttle portion 46*a* formed as described above, the flow rate of the cooling water flowing from the main cooling water passage 31 into the intake-side cooling water passage 35 is reduced, and the flow rate of the cooling water in the main cooling water passage 31 is reliably maintained. As a result, the vicinity of the combustion chambers 11 can be effectively cooled.

As illustrated in FIG. 5, each of the upper exhaust-side cooling water passage 32 and the lower exhaust-side cooling water passage 33 has such a substantially sector-like shape that an intermediate portion thereof in the lengthwise direction of the cylinder head 4 is expanded toward the exhaust-side lateral surface 4*e* to cover the entirety of the exhaust collecting portion 14.

As illustrated in FIGS. 2, 4 and 6, a groove 43*b* recessed downwards and extending in the lengthwise direction of the cylinder head 4 is formed in the lower exhaust-side passage defining portion 43 along its lower edge close to the exhaust-side lateral surface 4*e* of the cylinder head 4. In other words, a portion of the lower exhaust-side cooling water passage 33, which portion is positioned close to the exhaust-side lateral surface 4*e* of the cylinder head 4, is expanded downwards, as viewed in a cross-section, to increase a passage cross-sectional area, thereby forming a shunt passage 40 in the lower exhaust-side cooling water passage 33 to extend along its lateral edge on the side close to the exhaust-side lateral surface 4*e*. The shunt passage 40 is formed to extend following the water flow in the lower exhaust-side cooling water passage 33, and it has a larger vertical dimension and smaller flow-passage resistance than those of the remaining portion of the lower exhaust-side cooling water passage 33. Therefore, the shunt passage 40 serves to ensure the flow rate of the cooling water flowing therethrough and to effectively cool the exhaust-pipe fastening boss portions 28 and the exhaust pipe fastening bolts 50 while suppressing an increase of the flow rate of the cooling water in the lower exhaust-side cooling water passage 33. In addition, since the shunt passage 40 is formed along the lateral edge of the lower exhaust-side cooling water passage 33, it cools the exhaust-pipe fastening boss portions 28 and the exhaust pipe fastening bolts 50 while minimizing an increase of the flow passage resistance of the lower exhaust-side cooling water passage 33. Thus, since the shunt passage 40 is formed in a part of the lower exhaust-side cooling water passage 33, the shunt passage 40 can be formed without increasing the number of manufacturing steps, and hence the cylinder head 4 can be easily manufactured.

Figure 11:
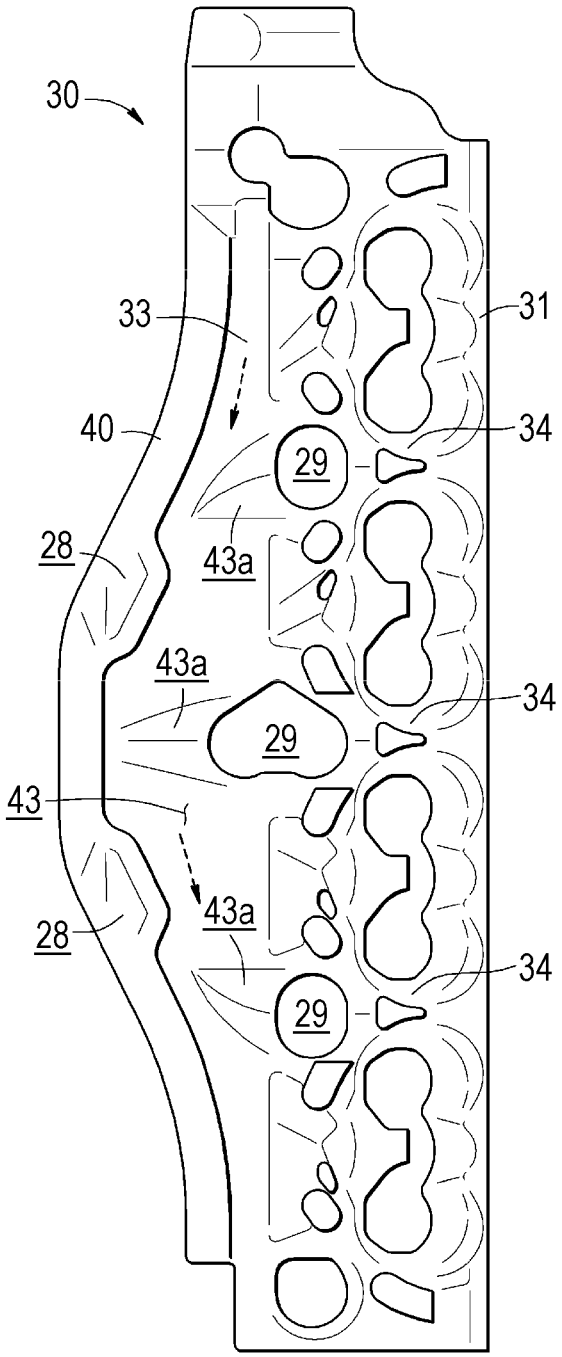
FIG. 11 is a bottom view illustrating the exhaust side of the cooling water passage according to the embodiment.

As illustrated in FIGS. 2, 4 and 11, at the lower edge of the lower exhaust-side passage defining portion 43 on the side close to the exhaust-side lateral surface 4*e* of the cylinder head 4, the exhaust-pipe fastening boss portions 28 are integrally formed to project into the lower exhaust-side cooling water passage 33. The shunt passage 40 is circularly curved so as to bypass the exhaust-pipe fastening boss portions 28. Stated another way, the shunt passage 40 is formed to entirely surround the exhaust-pipe fastening boss portions 28 in order to prevent a decrease of the passage cross-sectional area thereof. As a result, the exhaust-pipe fastening boss portions 28 and the exhaust pipe fastening bolts 50 can be effectively cooled while minimizing an increase of the flow passage resistance and maintaining the flow rate of the cooling water in the shunt passage 40. Further, as illustrated in FIG. 2, the shunt passage 40 includes not only a first shunt passage 40*a* that is formed to surround the exhaust-pipe fastening boss portions 28 while bypassing them, and a second shunt passage 40*b* that is formed between the exhaust-pipe fastening boss portions 28 and the exhaust collecting portion 14 (i.e., in the exhaust-collecting-portion defining portion 24). With the shunt passage 40 thus formed, the exhaust-pipe fastening boss portions 28 are sufficiently cooled with the first shunt passage 40*a* along their entire lateral surfaces in the lengthwise direction, and further with the second shunt passage 40*b* along their surfaces (upper surfaces) on the side close to the exhaust collecting portion 14. As a result, thermal damage possibly caused in the surroundings of the exhaust-pipe fastening boss portions 28 can be suppressed. In addition, since the shunt passage 40 is divided into a two-way passage, the cooling water is less apt to stagnate around the exhaust-pipe fastening boss portions 28.

A plurality (three in the illustrated embodiment) of transverse projections 43*a* projecting into the lower exhaust-side cooling water passage 33 are formed on a lower surface of the lower exhaust-side passage defining portion 43. Each of the transverse projections 43*a* is formed to extend in a direction traversing the flow of the cooling water flowing from the cooling water inlet port 37 toward the cooling water outlet port 38 as indicated by arrows, and is arranged between adjacent two of the cylinders 2. In other words, three transverse projections 43*a* are arranged in the lower exhaust-side cooling water passage 33 at predetermined intervals from the upstream side toward the downstream side. The upper and lower exhaust-side cooling water passages 32, 33 formed to sandwich the exhaust collecting portion 14 tend to have comparatively large cross-sectional areas. With the provision of the transverse projections 43*a* formed as described above, however, the flow passage resistance of the lower exhaust-side cooling water passage 33 is increased, thus resulting in a structure allowing the cooling water to easily flow through the main cooling water passage 31. As a result, the vicinity of the combustion chambers 11, which is subjected to high temperature, can be reliably cooled even with a less amount of the cooling water.

Each transverse projection 43*a* is formed such that it is continuously joined to the cylinder-head fastening boss portion 29 provided between adjacent two of the cylinders 2, but it does not reach up to the shunt passage 40. Thus, since the transverse projections 43*a* are formed to be continuously joined to the cylinder-head fastening boss portions 29, the transverse projections 43*a* can be molded integrally with the cylinder-head fastening boss portions 29 existing in the cylinder head 4, and hence fabrication of the transverse projections 43*a* is easy to carry out. Further, since the transverse projections 43*a* are formed not to reach up to the shunt passage 40, it is possible to simultaneously realize effective cooling of the exhaust pipe fastening bolts 50 with the shunt passage 40 and effective cooling of the vicinity of the combustion chambers 11 with the main cooling water passage 31.

Figure 12:
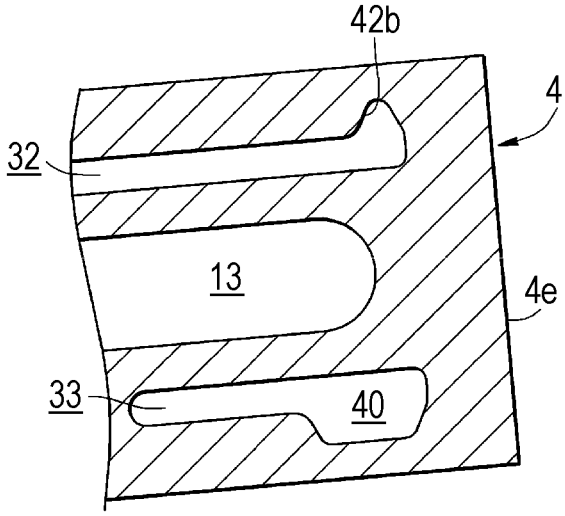
FIG. 12 is a sectional view taken along a line XII-XII in FIG. 5.

As illustrated in FIGS. 5 and 12, in an end portion of an upper wall surface of the upper exhaust-side passage defining portion 42 on the side close to the cooling water outlet port 38 and close to the exhaust-side lateral surface 4*e*, a concave channel 42*b* recessed upwards and extending in the lengthwise direction of the cylinder head 4 is formed to move air having entered the cylinder-head cooling water passage 30 toward the cooling water outlet port 38.

Because the engine 1 is mounted in such a state that the cylinder axis 2X is inclined in the direction at which the exhaust-side lateral surface 4*e* of the cylinder head 4 is caused to direct upwards, the air having entered the cylinder-head cooling water passage 30 tends to stagnate at the highest position, i.e., at the edge of an intermediate portion of the upper exhaust-side cooling water passage 32, as viewed in the lengthwise direction thereof, on the side close to the exhaust-side lateral surface 4*e*. With the provision of the concave channel 42*b* formed as described above, however, the air having entered the upper exhaust-side cooling water passage 32 is movable toward the cooling water outlet port 38. Hence, the effect of cooling the vicinity of the combustion chambers 11 with the cooling water passage 30 in the cylinder head 4 can be prevented from reducing due to the presence of stagnant air.

While the embodiment has been fully described above, the embodiment of the present invention can be practiced in widely and variously modified forms without being limited to the foregoing embodiment. For example, while the cooling water passage structure in the cylinder head according to the above-described embodiment of the present invention is applied to an in-line 4-cylinder gasoline engine, it is further applicable to various internal combustion engines, which differ in type and purpose, such as a V-type or horizontal opposed engine, multi-cylinder engines other than the 4-cylinder engine, a diesel engine, an alcohol fueled engine, and a marine engine.

While, in the above-described embodiment, the shunt passage 40 is formed by expanding the lateral edge of the lower exhaust-side cooling water passage 33 downwards because the exhaust-pipe fastening boss portions 28 are disposed under the lower exhaust-side cooling water passage 33. However, when the exhaust-pipe fastening boss portions 28 are disposed above the lower exhaust-side cooling water passage 33, the shunt passage 40 may be formed by expanding the lateral edge of the lower exhaust-side cooling water passage 33 upwards. Also, in the above-described embodiment, the shunt passage 40 is formed in only the lower exhaust-side cooling water passage 33 because the exhaust-pipe fastening boss portions 28 are projected into only the lower exhaust-side cooling water passage 33. However, when the exhaust-pipe fastening boss portions 28 are projected into the upper exhaust-side cooling water passage 32 as well, the shunt passage 40 may be formed in the upper exhaust-side cooling water passage 32 as well by partly recessing the upper exhaust-side passage defining portion 42 toward the side close to the exhaust-pipe fastening boss portions 28. In such a case, the shunt passage 40 is preferably formed to surround the exhaust-pipe fastening boss portions 28 while bypassing them. Further, in the above-described embodiment, because the cooling water inlet port 37 is formed at one end of the cylinder head 4 in the lengthwise direction thereof and the cooling water outlet port 38 is formed at the other end thereof, the shunt passage 40 is formed to extend along the lateral edge of the lower exhaust-side cooling water passage 33 on the side close to the exhaust-side lateral surface 4*e* in a shape following the flow of the cooling water. Depending on the positions of the cooling water inlet port 37 and the cooling water outlet port 38, however, the shunt passage 40 may be formed, for example, in a shape extending in the transverse direction of the cylinder head. In addition, actual constructions, arrangements, etc. of the other various members and portions can be changed, as appropriate, without departing from the scope of the present invention.

According to the embodiment of the present invention, since the shunt passage is formed by partly expanding the first exhaust-side cooling water passage or the second exhaust-side cooling water passage, the shunt passage can be formed without increasing the number of manufacturing steps. Also, since the shunt passage is formed to extend following the water flow, flow passage resistance is not increased. Further, since the expanded shunt passage has smaller flow passage resistance than that of the first exhaust-side cooling water passage or the second exhaust-side cooling water passage, the flow rate of the cooling water in the shunt passage can be ensured to effectively cool the fastening member while an increase in the flow rate of the cooling water in the first exhaust-side cooling water passage and the second exhaust-side cooling water passage is suppressed.

Further, in the cooling water passage structure in the cylinder head of the internal combustion engine according to the embodiment of the present invention, preferably, the cylinder head includes a cooling water inlet port formed at one end side thereof in the lengthwise direction and a cooling water outlet port formed at the other end side thereof in the lengthwise direction, the first exhaust-side cooling water passage and the second exhaust-side cooling water passage guide cooling water to flow in the lengthwise direction of the cylinder head, and the shunt passage is formed in the first exhaust-side cooling water passage or the second exhaust-side cooling water passage to extend along a lateral edge thereof on the side close to the exhaust-side lateral surface.

According to the embodiment of the present invention, since the shunt passage is formed in the first exhaust-side cooling water passage or the second exhaust-side cooling water passage to extend along the lateral edge thereof on the side close to the exhaust-side lateral surface, an increase in the flow passage resistance of the first exhaust-side cooling water passage or the second exhaust-side cooling water passage can be minimized.

Still further, in the cooling water passage structure in the cylinder head of the internal combustion engine according to the embodiment of the present invention, preferably, a fastening boss portion (exhaust-pipe fastening boss portion) adapted to fasten the fastening member is projected into at least one of the first exhaust-side cooling water passage and the second exhaust-side cooling water passage, and the shunt passage is formed to surround the fastening boss portion while bypassing the fastening boss portion.

According to the embodiment of the present invention, since the fastening boss portion is projected into the first exhaust-side cooling water passage or the second exhaust-side cooling water passage, a thickness of the cylinder head can be reduced. Further, even with the fastening boss portion projected into the cooling water passage, since the shunt passage is formed to surround the fastening boss portion while bypassing it, the fastening boss portion can be effectively cooled while the flow rate of the cooling water in the shunt passage is maintained.

Still further, in the cooling water passage structure in the cylinder head of the internal combustion engine according to the embodiment of the present invention, preferably, the shunt passage includes a first shunt passage bypassing the fastening boss portion, and a second shunt passage formed between the fastening boss portion and the exhaust collecting portion.

According to the embodiment of the present invention, not only the entirety of the fastening boss portion in the lengthwise direction thereof can be sufficiently cooled with the first shunt passage bypassing the fastening boss portion, but also a part of the fastening boss portion between the shunt passage and the exhaust collecting portion can be sufficiently cooled with the second shunt passage. As a result, thermal damage possibly caused in the surroundings of the fastening boss portion can be suppressed. In addition, since the shunt passage is divided into a two-way passage, the cooling water is less apt to stagnate around the fastening boss portion.

According to the embodiment of the present invention, as described above, the cooling water passage structure in the cylinder head is provided which is capable of effectively cooling the boss portion for the bolt for fastening the exhaust pipe while suppressing an increase in the flow rate of the cooling water in the cooling water passage to cool the surroundings of the exhaust collecting portion.

Obviously, numerous modifications and variations of the present invention are possible in light of the above teachings. It is therefore to be understood that within the scope of the appended claims, the invention may be practiced otherwise than as specifically described herein.

What is claimed is:

1. A cooling water passage structure in a cylinder head of an internal combustion engine, comprising:

a first exhaust-side cooling water passage and a second exhaust-side cooling water passage arranged to sandwich an exhaust collecting portion of the cylinder head and extending in a lengthwise direction of the cylinder head, the exhaust collecting portion being formed in the cylinder head to define an exhaust opening in an exhaust-side lateral surface of the cylinder head and to collect exhaust gases exhausted from a plurality of combustion chambers which are arrayed in a line, an exhaust pipe being fastened to the exhaust-side lateral surface of the cylinder head via a fastening member and being adapted to arrange an exhaust cleaner immediately downstream of the exhaust opening; and a shunt passage formed in at least one of the first exhaust-side cooling water passage and the second exhaust-side cooling water passage to cool the fastening member, the shunt passage being formed along a water flow in the first exhaust-side cooling water passage or the second exhaust-side cooling water passage by partly expanding a part of a lateral edge of the first exhaust-side cooling water passage or the second exhaust-side cooling water passage on a side close to the exhaust-side lateral surface to increase a passage cross-sectional area of the first exhaust-side cooling water passage or the second exhaust-side cooling water passage, wherein the shunt passage including a first shunt passage and a second shut passage, the first shunt passage being formed to bypass a fastening boss portion in a direction in which the fastening member is fastened to the fastening boss portion, the second shunt passage being formed sandwiched between the fastening boss portion facing the exhaust collecting portion and the exhaust collecting portion to cool the surface of the fastening boss portion on a side close to the exhaust collecting portion.

2. The cooling water passage structure in the cylinder head of the internal combustion engine according to claim 1, wherein a cooling water inlet port is formed at one end side of the cylinder head in the lengthwise direction, and a cooling water outlet port is formed at another end side of the cylinder head in the lengthwise direction, wherein the first exhaust-side cooling water passage and the second exhaust-side cooling water passage guide cooling water to flow in the lengthwise direction of the cylinder head, and wherein the shunt passage is formed along the lateral edge of at least one of the first exhaust-side cooling water passage and the second exhaust-side cooling water passage on a side close to the exhaust-side lateral surface.

3. The cooling water passage structure in the cylinder head of the internal combustion engine according to claim 2, wherein the fastening boss portion is projected toward at least one of the first exhaust-side cooling water passage and the second exhaust-side cooling water passage, and wherein the shunt passage is formed to surround the fastening boss portion while bypassing the fastening boss portion.

4. The cooling water passage structure in the cylinder head of the internal combustion engine according to claim 3, wherein the first shunt passage is formed between the fastening boss portion and the first exhaust-side cooling water passage or the second exhaust-side cooling water passage.

5. A cooling water passage structure in a cylinder head of an internal combustion engine, comprising:

a first exhaust-side cooling water passage and a second exhaust-side cooling water passage arranged to sandwich an exhaust collecting portion of the cylinder head and extending in a lengthwise direction of the cylinder head in which a plurality of combustion chambers are arrayed, each of the first exhaust-side cooling water passage and the second exhaust-side cooling water passage being provided to guide cooling water to flow in the lengthwise direction, the exhaust collecting portion being formed in the cylinder head to define an exhaust opening in an exhaust-side lateral surface of the cylinder head, a downstream end portion of the exhaust collecting portion being connected to the exhaust opening, the exhaust collecting portion including a plurality of exhaust ports having upstream end portions connected to the plurality of combustion chambers, an exhaust pipe being fastened to the exhaust-side lateral surface of the cylinder head via a fastening member and being adapted to arrange an exhaust cleaner immediately downstream of the exhaust opening;

a fastening boss portion to which the fastening member is secured and which is projected at a lateral edge of at least one of the first exhaust-side cooling water passage and the second exhaust-side cooling water passage, the lateral edge being close to the exhaust-side lateral surface; and a shunt passage formed in the at least one of the first exhaust-side cooling water passage and the second exhaust-side cooling water passage, the shunt passage being formed along a water flow in the at least one of the first exhaust-side cooling water passage and the second exhaust-side cooling water passage by expanding a part of the lateral edge of the at least one of the first exhaust-side cooling water passage and the second exhaust-side cooling water passage on a side close to the exhaust-side lateral surface when viewed on a cross-section taken along a plane perpendicular to the lengthwise direction, the shunt passage being formed to bypass the fastening boss portion to increase a cross-sectional area of the shunt passage at a position at which the fastening boss portion is projected when viewed on the cross section taken along the plane perpendicular to the lengthwise direction, the shunt passage including a first shunt passage and a second shut passage, the first shunt passage being formed to bypass the fastening boss portion in a direction in which the fastening member is fastened to the fastening boss portion, the second shunt passage being formed sandwiched between the fastening boss portion facing the exhaust collecting portion and the exhaust collecting portion to cool the surface of the fastening boss portion on a side close to the exhaust collecting portion.

* * * * *